United States Patent [19]

Hanson

[11] 4,299,039

[45] Nov. 10, 1981

[54] FOOTWEAR HAVING HEEL WIDTH ADJUSTMENT

[75] Inventor: Chris A. Hanson, Boulder, Colo.

[73] Assignee: Hanson Industries Incorporated, Boulder, Colo.

[21] Appl. No.: 130,195

[22] Filed: Mar. 13, 1980

[51] Int. Cl.[3] ..... A43B 3/26; A43B 5/04

[52] U.S. Cl. ..... 36/97; 36/117

[58] Field of Search ..... 36/117, 118, 119, 120, 36/121, 105, 50, 97

[56] References Cited

U.S. PATENT DOCUMENTS

| | | | |
|---|---|---|---|
| 2,680,310 | 6/1954 | Laird et al. | 36/50 |
| 3,798,799 | 3/1974 | Hanson et al. | 36/119 |
| 4,083,130 | 4/1978 | Pertetto et al. | 36/50 |
| 4,192,087 | 3/1980 | Salomon | 36/119 |

*Primary Examiner*—Patrick D. Lawson

*Attorney, Agent, or Firm*—Merriam, Marshall & Bicknell

[57] ABSTRACT

Improved footwear, such as a ski boot having a substantially rigid shell, a split section in the rear, lower boot heel portion with a slit commencing at a circular aperture in the shell and extending upwardly, and adjustable fastening means mounted across the slit for varying the slit width and thereby adjusting the split section at the heel portion to the wearer's heel width size.

4 Claims, 4 Drawing Figures

FOOTWEAR HAVING HEEL WIDTH ADJUSTMENT

This invention relates to ankle-covering boots suitable for use in sports footwear, such as custom-fitted ski boots and improvements therein to enable the lower boot, heel portion to be adjusted to the wearer's heel width size.

BACKGROUND OF THE INVENTION

Reference may be made to the following U.S. Patents of interest: Nos. 3,798,799; 3,848,374; 3,882,561; and 4,083,127, all assigned to the same assignee as herein.

Many ski boots presently available comprise a substantially rigid outer shell generally made of a plastic material. A liner member is normally disposed within the shell and serves as a cushion between the shell and the foot of a skier. Generally, it is desired to have the ski boot and its components adapted to surround and be contoured to custom-fit the wearer's foot. In such cases, the boot is to provide a support function for the wearer's foot and ankle and enable firm contact to be obtained between the foot and the boot. Reference may be made to the aforementioned Patent Nos. 3,798,799 and 3,882,561 wherein the custom fitting operation is disclosed.

Because of the relatively stiff plastic materials utilized in ski boot shells, the shell of the boot is substantially rigid and includes a rear entry opening in the shell for inserting and removing one's foot. After the skier inserts his foot into the shell, the shell opening is suitably tightened around the wearer's lower leg and ankle area by means of one or more adjustably positioned releasable latches.

It is now desired to provide means for adjusting the rear, lower boot portion of the shell in the area of the heel to conform to the wear's heel width size.

SUMMARY OF THE INVENTION

In accordance with the principles of the present invention, an adjustable split section is provided in the rear, lower boot portion of a substantially rigid boot shell. Specifically, the adjustable split section includes a slit in the rear shell heel area, and an adjustable threaded fastener mounted across the slit. With the foot in the boot, the fastener is threadably adjusted to vary the slit width and thereby loosen or tighten the rear boot heel area to conform to the wearer's heel width.

The bottom end of the slit in the split section is terminated in a circular aperture having a diameter greater than the slit width. This distributes the stress forces in the slit end so as to prevent any tendency to tear or split the boot shell. The slit extends from the circular aperture upwardly in the shell rear.

DETAILED DESCRIPTION

Figure 1:
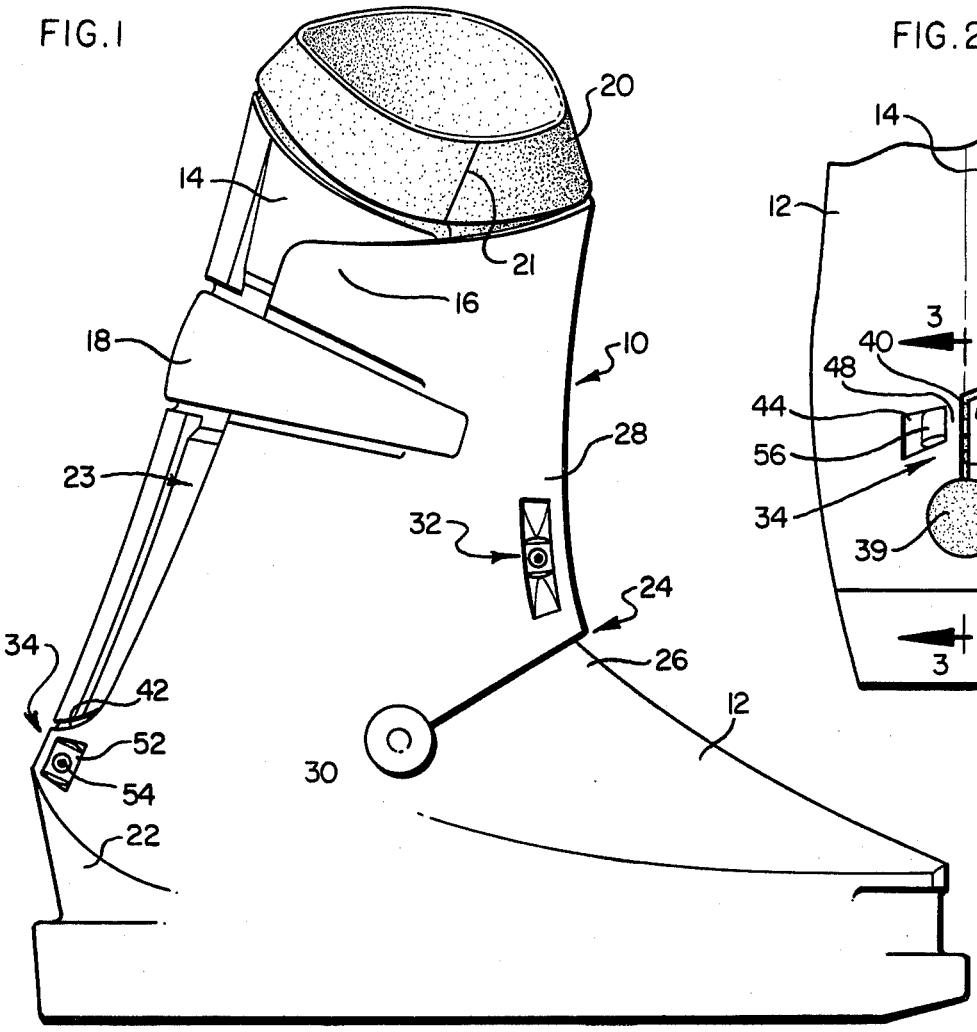
FIG. 1 is a side elevational view of a ski boot including means for adjusting the boot heel portion to the wearer's heel width.

In the drawings, FIGS. 1–4, the invention is illustrated in connection with a ski boot, it being understood, however, that the principles can be applied to other footwear, particularly footwear employing a substantially rigid shell.

Referring now to FIG. 1, there is illustrated a ski boot 10 having a substantially rigid outer shell 12 of the rear entry type. The boot 10 includes a substantially non-compressable stiff plastic material forming a one-piece outer shell 12. An upright shell portion 14 extends around the wearer's lower leg to lie beneath upright shell portion 16. Shell portions 14 and 16 may be spread apart to enable entry of a skier's foot within the shell 12. Closure means 18 releasably locks shell portions 14 and 16 and permits the wearer to adjustably tighten the boot on his foot. A liner 20 formed of polyurethane foam or other substantially flexible material is contoured to fit within the shell 12. It is to be understood that both the liner 20 and the outer shell 12 are split in the area of boot portions 14 and 16, from the top thereof downwardly to about the heel portion 22 of the boot to permit entry and removal of the wearer's foot. The top 21 of the liner split and the shell wrap-around split 23 are shown in FIG. 1.

The boot front includes a slip joint 24 formed between the vamp portion 26 and an upper boot portion 28. The slip joint extends from a grommet 30, in a suitable shell aperture, across the boot front to a similar grommet on the other side and provides boot flexure. Adjustable fastening means 32 in the upper boot portion enable the amount of flexure to be varied.

Figure 2:
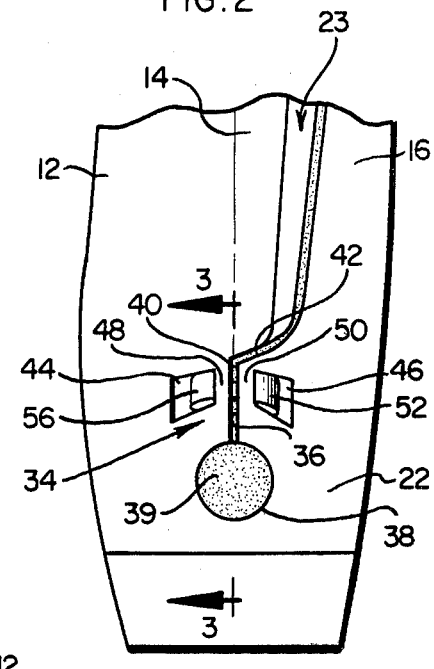
FIG. 2 is a fragmentary rear view of the ski boot of FIG. 1, illustrating an adjustable split section at the boot heel area.
Figure 3:
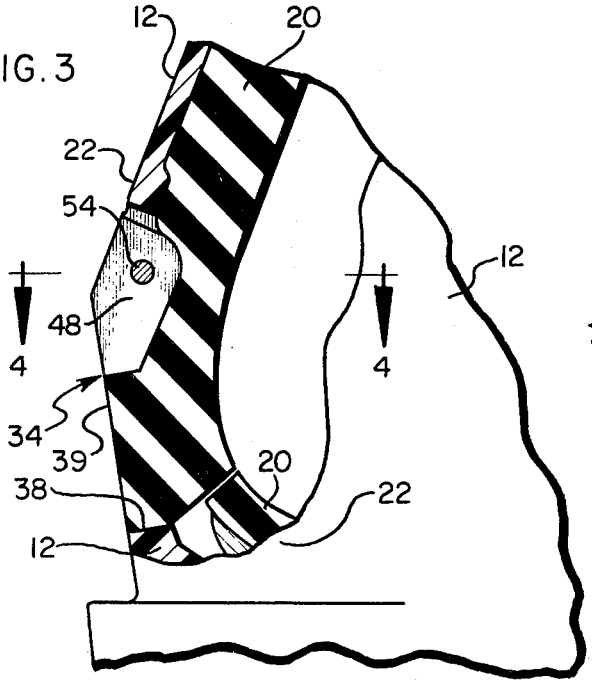
FIG. 3 is a fragmentary sectional view taken along section line 3—3 of FIG. 2, illustrating construction details.
Figure 4:
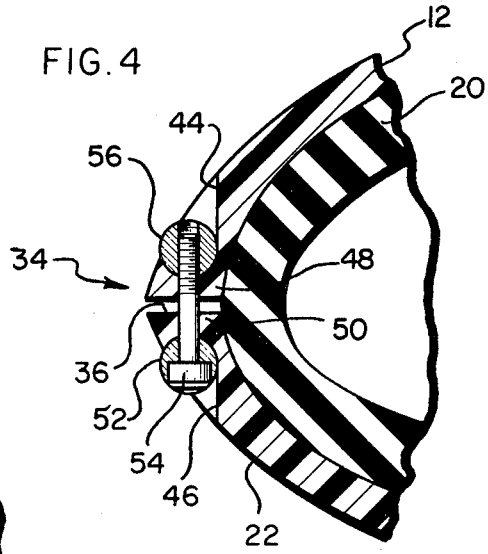
FIG. 4 is a fragmentary sectional view taken along section line 4—4 of FIG. 3, illustrating an adjustable fastener mounted across the boot split section.

With reference to FIG. 2, shell 12 at the boot heel portion 22 includes an adjustable split section 34 formed with a slit 36 extending upwardly from a circular aperture 38. Aperture 38 has a diameter larger than the width of slit 36 so as to distribute any stresses at the slit bottom and thereby prevent tearing of the shell 12. Liner 20 includes a button 39 extending therefrom to sealingly fit within aperture 38. At the slit top 40, a transverse slit 42 in shell 12 communicates slit 36 in shell split section 34 with the wrap-around shell split opening 23.

A pair of aligned recesses 44, 46 in respective walls 48, 50 alongside slit 36 accommodate adjustable fastening means for varying the slit width. In particular, a backing member 52 having a suitable aperture to accommodate a threaded screw 54 is mounted in recess 46. A similar backing member 56 includes a threaded aperture and is mounted in the opposite recess 44. Threaded screw 54 may be inserted through backing member 52 and suitable aligned apertures in walls 48, 50 to threadably engage backing member 56. Backing member 56 acts as a locking nut to maintain the desired threaded screw position for the desired heel width size adjustment.

With the wearer's foot inserted in the boot 10, screw 54 is adjustably threaded into backing member 56 (see FIG. 4) so as to vary the width of slit 36 to conform to the wearer's heel width size. Thereafter, the wearer may insert and remove his foot from the boot by opening closure member 18 without changing the position of screw 54. Thus, the lower, substantially rigid shell portion 22 can be conformed to the wearer's heel width.

While particular embodiments of the present invention have been shown and described, it will be obvious to those skilled in the art that various changes and modifications may be made without departing from the invention in its broader aspects. Accordingly, the aim of the appended claims is to cover all such changes and modifications as may fall within the true spirit and scope of the invention.

What is claimed is:

1. In a substantially rigid plastic boot shell having a split rear section opening for foot entry and at least one closure means across said opening adapted for closing the shell about a wearer's foot, the improvement of means for adjustably setting the boot heel portion to the wearer's heel width size, said improvement comprising:

a longitudinal slit commencing in said boot heel portion and extending upwardly to communicate with said split rear section opening;

adjustable fastening means mounted in said boot heel portion on both sides of said slit, including a threaded screw extending across said longitudinal slit and positionable for varying the width of said slit and setting the boot heel portion to conform to the wearer's heel width size, said adjustable fastening means permitting entry and exit of said foot from said boot shell through release of said closure means without repositioning said threaded screw.

2. In a substantially rigid plastic boot shell according to claim 1, further including an aperture in said boot heel portion communicating with the lower end of said longitudinal slit, said aperture having a diameter larger than the width of said slit.

3. In a substantially rigid plastic boot shell according to claim 1, wherein said adjustable fastening means includes a threaded locking member adapted for mounting in said boot heel portion on one side of said longitudinal slit and threadably engageable with said threaded screw for maintaining a threaded screw position corresponding to the set boot heel portion conforming to the wearer's heel width size.

4. In a substantially rigid plastic boot shell according to claim 1, wherein said longitudinal slit includes a transverse portion communicating the top of the slit with the split rear section opening.

* * * * *

UNITED STATES PATENT AND TRADEMARK OFFICE

CERTIFICATE OF CORRECTION

PATENT NO. : 4,299,039

DATED : November 10, 1981

INVENTOR(S) : Chris A. Hanson

It is certified that error appears in the above-identified patent and that said Letters Patent are hereby corrected as shown below:

Col. 1, line 39, "wear's" should be --wearer's--.

Page 1 under References Cited, "Pertetto" should be --Bertetto--.

Signed and Sealed this

*Sixteenth* Day of *February 1982*

[SEAL]

*Attest:*

GERALD J. MOSSINGHOFF

*Attesting Officer*

*Commissioner of Patents and Trademarks*